United States Patent [19]

Stinson

[11] Patent Number: 4,576,073

[45] Date of Patent: Mar. 18, 1986

[54] SAW BLADE GUARD

[76] Inventor: Robert J. Stinson, 2055 Lathers Ave., Garden City, Mich. 48135

[21] Appl. No.: 509,918

[22] Filed: Jul. 1, 1983

[51] Int. Cl.[4] ..... B27B 5/29

[52] U.S. Cl. ..... 83/102.1; 83/478; 83/544

[58] Field of Search ..... 83/478, 544-546, 83/698-700, 477.2, 102.1, 481

[56] References Cited

U.S. PATENT DOCUMENTS

| | | | |
|---|---|---|---|
| 1,527,587 | 2/1925 | Hutchison | 83/478 X |
| 2,876,810 | 3/1959 | Peterson et al. | 83/478 X |
| 3,290,100 | 12/1966 | Leciejewski | 308/6 R |

*Primary Examiner*—James M. Meister
*Assistant Examiner*—John L. Knoble
*Attorney, Agent, or Firm*—Krass and Young

[57] ABSTRACT

A saw blade guard for a table saw or the like includes a flat blade guard arm which is coplanar with the circular cutting blade and has a thickness no greater than that of the blade. The guard includes a yoke portion mounted on a bearing on the blade arbor below the table such that the yoke is allowed to rotate independently of the rotation of the arbor. The guard arm is semicircular in shape and extends through the kerf in the workpiece produced by the saw blade and down through the blade slot in the table to a point adjacent the yoke. The yoke includes a radially radial extension which supports the arm below the table. A roller mounted on the outer free extremity of the guard arm above the table is engaged by the leading edge of the workpiece and forces the arm to rotate a sufficient amount to expose the workpiece to the blade. A counterweight mounted on the yoke below the table biases the guard arm to normally rotate into covering relationship to the blade such that the roller bears against the workpiece at all times.

16 Claims, 5 Drawing Figures

SAW BLADE GUARD

TECHNICAL FIELD

The present invention broadly relates to guards for protecting an operator from contacting the blade of a circular saw, and deals more particularly with saw blade guards for table-type circular saws.

BACKGROUND ART

Various devices have been proposed in the past for protectively covering the circular saw blade of table-type saws. Saws of this type typically comprise a flat, tablelike surface for supporting a workpiece and a slot in the table through which a portion of a circular saw blade extends. The saw blade is mounted on a motor driven arbor below the table which is in turn pivotally mounted so as to allow tilting of the blade relative to the upper table surface.

One type of known prior art blade guard is mounted on top of the table and includes a housing covering the upper portion of the blade and extending above the thickness of the workpiece. This type of blade guard possesses a number of disadvantages. For example, a portion of the blade at the front and rear of the guard immediately above the table surface is exposed both before and after the cut, thus presenting a risk of injury to the operator. Also, these guards limit the movement of the rip fence toward the blade, thereby limiting the use of the saw with these workpieces.

Prior art blade guards of the type described above may also interfere with efficient workpieces feed because of the various brackets and mounting mechanisms which are disposed on top of the table. In some cases, the blade guard housing is rather wide and bulky and can present a visual obstruction at the leading edge of the blade which interferes with the operator's view of the alignment between the blade and the workpiece.

Still another problem of prior art blade guards is that of alignment between the blade guard and the blade. Blade/guard alignment is sometimes inadvertently altered when it is necessary to adjust the guard relative to the blade due to the nature of the mounting brackets involved. Since the prior art guards employ mounting brackets that extend above the table top and limit the movement of workpieces through the blade operators often disable the guards to achieve freedom of use of the saw, thereby creating a safety hazard.

In view of the foregoing, there is a clear need in the art for a saw blade guard especially for table saws which overcomes each of the deficiencies discussed above.

Accordingly, it is the primary object of the present invention to provide a saw blade guard which is relatively simple in construction and does not require adjustment or manipulation by the operator to accommodate workpieces of varying thicknesses.

Another object is to provide a saw blade guard which does not in any way restrict the use of the saw to make all normal cuts and does not require any extra manipulation by the operator in order to achieve these cuts.

Another object of the invention is to provide a saw blade guard as described above particularly suited for a table saw which is mounted below the table and covers the entire periphery of the blade exposed above the table.

A still further object of the invention is to provide a saw blade guard as described above which normally covers the blade, but is automatically shifted in response to engagement therewith by a workpiece to expose the leading edge of the blade to the workpiece while covering the trailing edge of the blade at all times, thus freeing both the operator's hands for feeding the workpiece.

Another object of the invention is to provide a saw blade guard as discussed above which remains in alignment with the blade at all times, even when the blade is tilted relative to the table.

These, and further objects of the invention will be made clear or become apparent during the course of the following description of a preferred embodiment of the present invention.

BRIEF SUMMARY OF THE INVENTION

According to the present invention, a saw blade guard for a table saw or the like includes a flat blade guard arm having a thickness slightly less than that of the circular cutting blade allowing the guard to extend through the kerf in a workpiece produced by the blade. As the work passes beyond the blade, the guard arm extends down through a slot in the table and is mounted on a yoke which includes an extension projecting radially from the saw blade arbor. The yoke is mounted on the arbor for rotation independent of the arbor and includes a counterweight which urges the yoke to rotate in a direction which biases the guard into a position covering the blade. A roller on the outer extremity of the guard arm is engaged by the leading edge of the workpiece and since the roller is supported above the axis of rotation of the yoke the force exerted by the workpiece forces the arm to rotate up over the leading edge of the workpiece a sufficient amount to expose the leading edge of the blade to the workpiece. As the workpiece is advanced, the roller rides over the top surface of the workpiece so that the workpiece and the guard cooperate to fully cover the blade. Since the guard arm is mounted along with the blade on the blade arbor, the guard arm remains coplanar with the blade at all times even when the blade is tilted relative to the table.

BRIEF DESCRIPTION OF THE DRAWINGS

In the drawings, which form an integral part of the specification and are to be read in conjunction therewith, and in which like reference numerals are employed to designate identical components in the various views.

DETAILED DESCRIPTION OF THE SPECIFIC EMBODIMENTS

Figure 1:
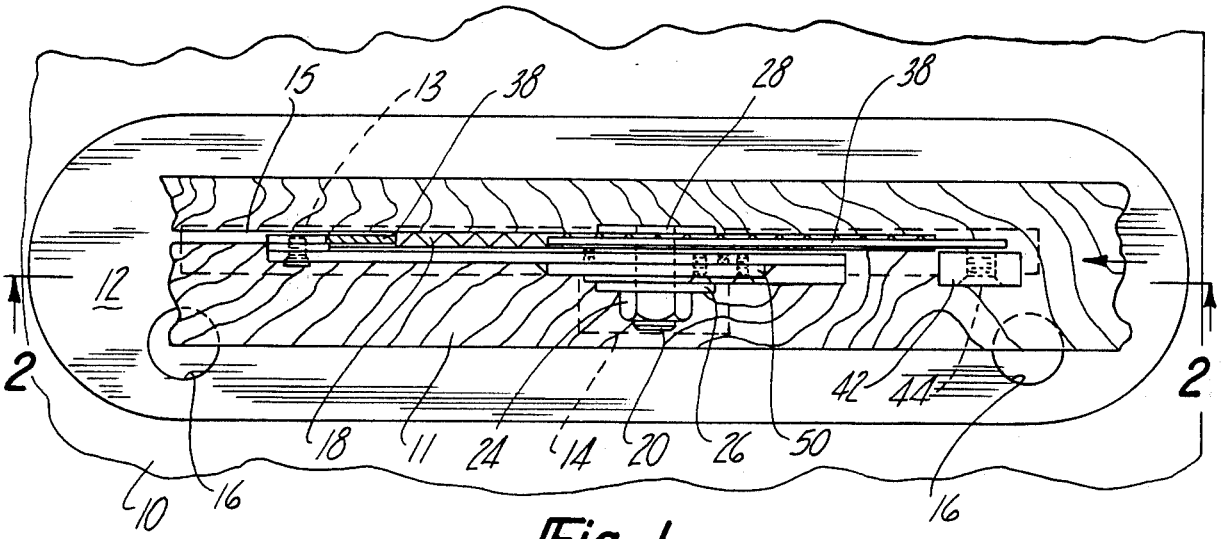
FIG. 1 is a fragmentary, top plan view of a portion of a table saw having the blade guard of the present invention installed thereon, parts of the guard arm being broken away in section.
Figure 2:
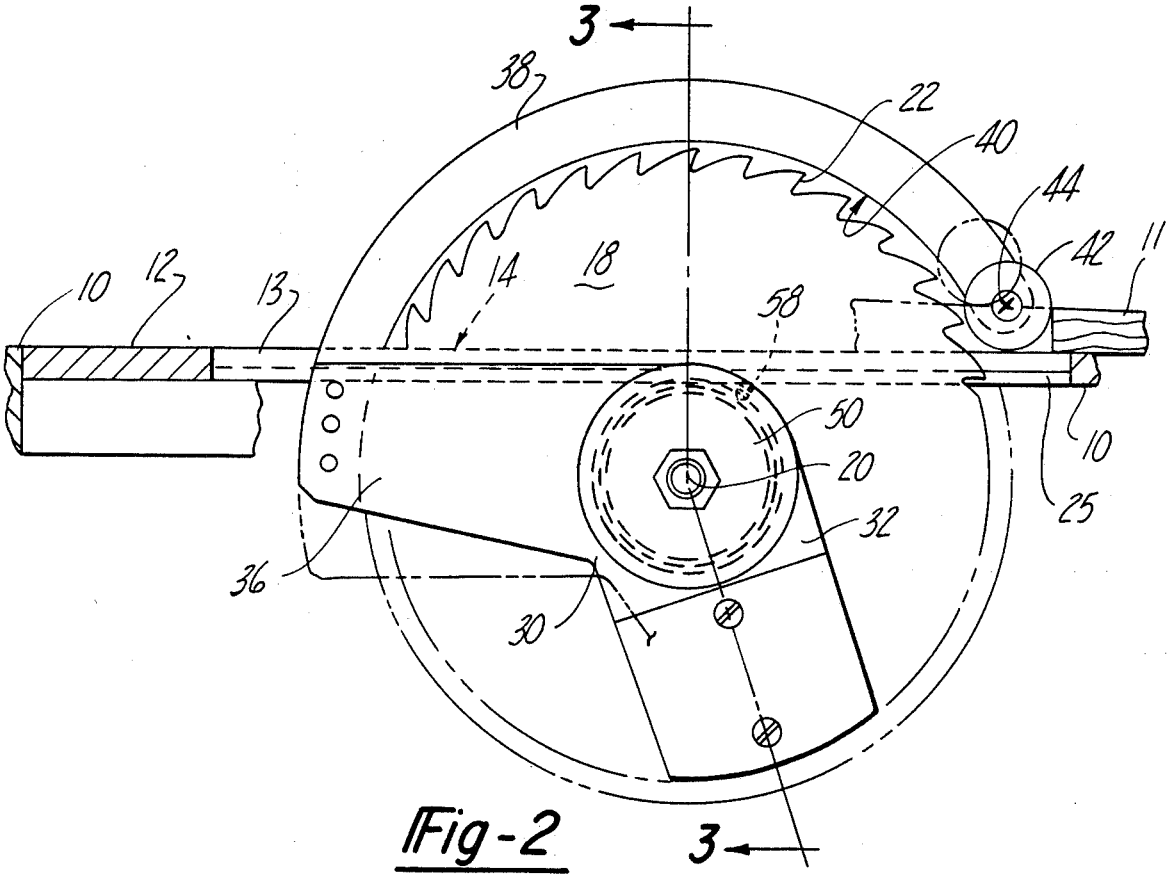
FIG. 2 is a sectional view taken along the line 2—2 in FIG. 1.
Figure 3:
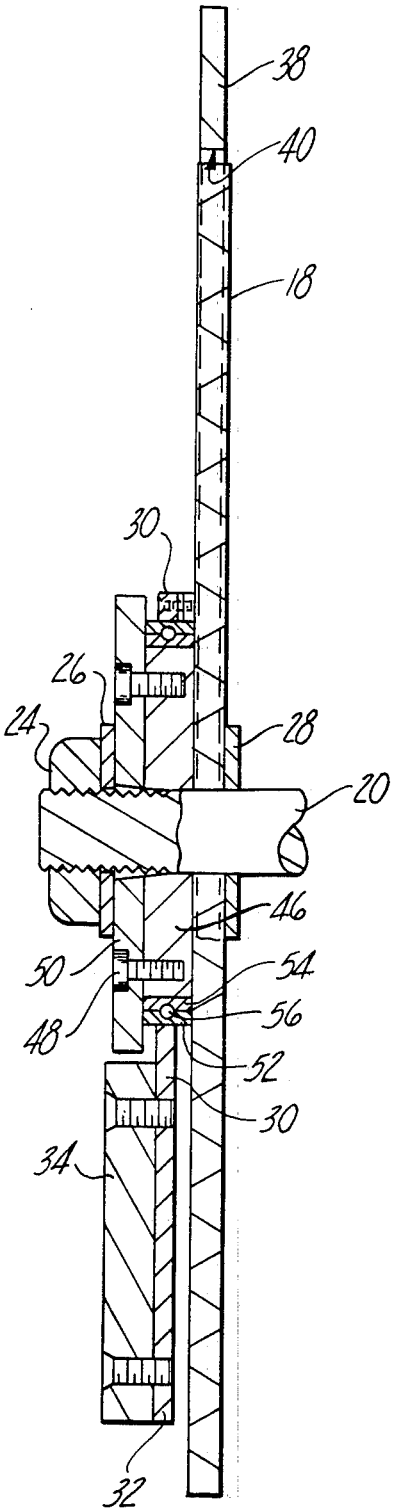
FIG. 3 is a sectional view taken along the line 3—3 in FIG. 2.

Referring first to FIGS. 1–3, the present invention is broadly concerned with a saw blade guard, especially for use with a table-type saw comprising a rotatable, motor-driven arbor 20 disposed beneath a table top 10. As will be discussed in more detail hereinbelow, a circular saw blade 18 having teeth 22 around the periphery thereof is mounted on the arbor 20 with the upper portion of the blade 18 extending above the table 10 through an elongate slot 13. Slot 13 is defined in an elongate insert 12 which is received within a depression in the top of table 10 and includes a pair of openings 16 at opposite ends into which fingers may be inserted for removing the insert 12 to permit access to the arbor 20 in order to allow changing of the blade 18, etc. The slot 13 includes a portion 14 of increased width for purposes which will become later apparent.

A workpiece 11 is supported on top of the table 10 and is slidably moved toward and through the blade 18 in order to produce a cut in the workpiece 11. The arbor 20 along with the motor (not shown) for driving same may be mounted on a conventional, tiltable platform (not shown) which permits tilting of the arbor 20 and thus of the blade 18 through a predefined angle in order to make an angled cut through the workpiece 11. Slot 13 is sufficiently wide to allow tilting of the blade 18 therewithin.

The present invention comprises a blade guard for covering the exposed portion of the blade 18 which extends above the table 10. The blade guard includes a yoke member 30 which is mounted on the arbor 20, by means later discussed, for rotation independent of rotation of the arbor 20. Yoke 30 includes a downwardly extending portion 32, the longitudinal axis of which is angularly displaced from the vertical. A counterweight 34 is mounted on the outer face of portion 32 by any suitable means.

Yoke 30 further includes a radially outwardly extending portion 36 whose outer extremity extends radially beyond the periphery of the blade 18. The yoke 30 preferably comprises a unitary plate of rigid metal. Attached to one face of the outer extremity of the radial extension 36 is a semicircular blade guard arm 38 which extends upwardly through the slot 13 at the rear of the blade 18. Arm 38 is preferably formed of flat metal and possesses a thickness no greater than that of the blade 18. Arm 38 includes an inner arcuately shaped edge or surface 40 which substantially matches the curvature of the blade 18 and is closely spaced from the teeth 22, preferably no more than from 1/32 to $\frac{1}{8}$ of an inch. Arm 38 is disposed substantially coplanar with the blade 18 so as to pass through a kerf in the workpiece 11 cut by the blade 18. The outer free extremity of the arm 38, which is normally disposed adjacent the front of the blade 18, has a rubber surfaced roller 42 mounted thereon by means of a screw 44 and spaced about $\frac{3}{8}$ inch from the guard so as to avoid interference with the blade. As shown in FIG. 2, the blade 18 normally rotates in a clockwise direction and the workpiece 11 is fed toward the blade 18 adjacent the free outer extremity of arm 38, consequently the leading edge of the workpiece 11 initially engages the roller 42 before a cut is commenced. Because of angular displacement of the longitudinal axis of the portion 32 on which counter weight 34 is mounted, the center of mass of the counterweight 34 is positioned toward the right of a vertical axis extending through the arbor 20. Consequently, counterweight 34 causes the yoke 30 and arm 38 to be urged to normally rotate clockwise on the arbor 20 so that the roller rides over the top of the workpiece as it is fed through the blade.

A nut 24 on the outer threaded end of arbor 20 tightly sandwiches the yoke 30 and blade 18 between a pair of washers 26 and 28. Yoke 30 and blade 18 are positioned in side-by-side relationship on the arbor 20 with the yoke 30 positioned outboard of the blade 18, and the guard arm 38 is mounted on the interior face of the radial extension 36 so as to be aligned in the same plane as the blade 18. The yoke 30 is mounted on arbor 20 by means of a hub assembly which is received within a circular opening in the yoke 30. The hug assembly includes an apertured, circular hub 46 sleeved over the arbor 20. Hub 46 is secured for rotation along with blade 18 on the arbor 20 by virtue of the pressure applied by nut 24. The yoke 30 is journalled for rotation on the hub 46 by means of a bearing assembly comprising an inner race 54 secured to the hub 46, roller bearings 56, and an outer race 52. Outer race 52 is secured to the yoke 30 by means of a set screw 58, thereby preventing rotation of the outer race 52 relative to the yoke 30. In order to assure that the bearing does not separate and allow the yoke 30 to shift laterally away from the hub 46, a circular retaining plate 50 is fastened to the hub 46 as with screws 48, with the outer periphery of the plate 50 covering both the inner and outer races 52, 54 of the bearing.

Turning now to the operation of the blade guard, as mentioned above, the counterweight 34 biases the yoke 30 to rotate clockwise on the arbor 20, thereby rotating the arm 38 until the roller 42 engages the top surface of the insert 12 prior to feeding the workpiece 11. In this standby position, the arm completely covers the exposed periphery of the blade 18 which extends above the table 10. In the standby position, the yoke 30 and arm 38 remain stationary while blade 18 is rotated by the arbor 20, due to the fact that the yoke 30 is journalled for rotation on the hub 46. In order to produce a cut in a workpiece 11, the workpiece 11 is advanced from right to left as viewed in FIGS. 1 and 2 toward the blade 18. During advancement, the leading edge of the workpiece 11 engages roller 42, thereby forcing roller 42 upwardly which in turn rotates arm 38 and yoke 30 counterclockwise to expose a small portion of the blade 18 to the thickness of the workpiece 11. Because of the constant rotational bias imposed by the counterweight 34, the roller 42 rides up over the leading edge of the workpiece 11 and bears downwardly against the upper surface of the workpiece 11, thus following the contour of the upper surface of the workpiece 11 as it is fed through the blade.

The blade 18 produces a cut or kerf 15 in a workpiece 11 which is as wide or slightly wider than the thickness of the blade 18. Consequently, the width of the kerf 15 is greater than the thickness of the guard arm 38. Since the arm 38 and blade 18 are aligned in the same plane, the arm 38 passes through the kerf 15 as the workpiece 11 is moved past the rear section of arm 38 which extends downwardly through the slot 13 in table 10.

When the trailing edge of the workpiece 11 has passed the roller 42, the biasing influence of counterweight 34 causes the arm 38 to rotate clockwise until the roller 42 engages the top surface of the insert 12, thereby again closing the small portion of the blade 18 which was presented to the leading edge of the workpiece 11. It is to be noted here that the blade guard is automatically responsive to the movement of the workpiece 11 and does not require operator manipulation in any manner. Moreover, adjustment of the blade guard is not required to accommodate workpieces of various thicknesses, rather, this is also accomplished automatically by the rotating action of the arm 38. Finally, the blade guard is mounted beneath the top of the table 10 on the arbor 20 thus avoiding any obstruction on the top of the table 10 which might interfere with feeding the workpiece 11. Also, when it is desired to tilt the blade 18 on tilt-type arbor table saws, it is not necessary to readjust the blade guard, but rather the blade guard, and particularly the guard arm 38 remains in aligned coplanar registration with the blade 18 regardless of the tilt of the blade 18.

Due to the use of the roller 42 which adds additional width to the outer end of the arm 38, it is necessary to replace the standard, slotted dustcover of most conventional table-type saws with an insert 12 of the type shown in the drawings. The portion 14 of the slot 13 which is of increased width allows insertion of the outer end of the arm 38 therethrough during installation of the guard on the saw. In some cases, it may be necessary to provide a longitudinally extending relief 25 in the bottom face of the insert 12 surrounding the slot 13 so as to provide a clearance area within which an edge of the counterweight 34 is received when the arm 38 is rotated to its maximum open position.

Figure 4:
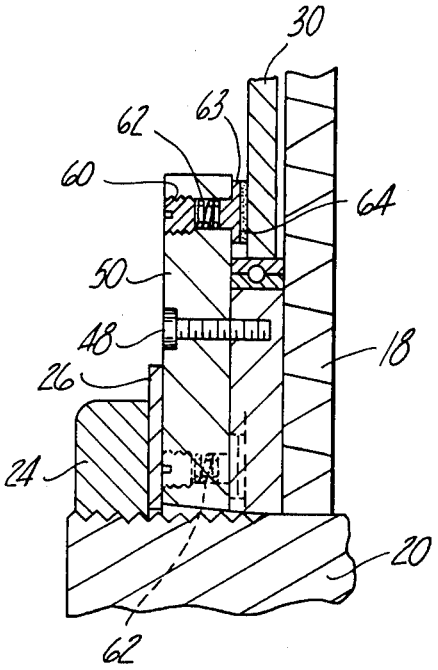
FIG. 4 is a fragmentary, sectional view of an upper portion of the blade arbor mounting having an alternate form of the blade guard installed thereon.

As is apparent from the foregoing description, the invention contemplates means for normally biasing the yoke 30 and arm 38 to rotate so as to maintain the arm 38 in covering relationship to the blade 18 and in this respect an alternate construction is shown in FIG. 4 for producing the desired biasing influence. The cover plate 50 includes a plurality of circumferentially spaced apertures outboard of the bearing 52 within each of which there is secured a threaded guide 60 and spiral spring 62 which has mounted on the outer end thereof a friction pad 63. Each of the friction pads 63 is loaded by the corresponding spring 62 into frictional engagement with an annularly shaped friction strip 64 which is secured on the outer face of the yoke 30. Recalling now that cover plate 50 rotates with arbor 20, the sliding friction between the pads 53 and strip 64 results in a rotational force being applied to the yoke 30 which produces the necessary biasing influence to maintain the arm 38 in covering relationship to the blade 18. Brushes of flexible fiber supported on the yoke or the cover plate, and bearing against the other or the blade might be alternatively employed to provide the bias force. Similarly, a relatively stiff bearing could also provide sufficient biasing force.

Figure 5:
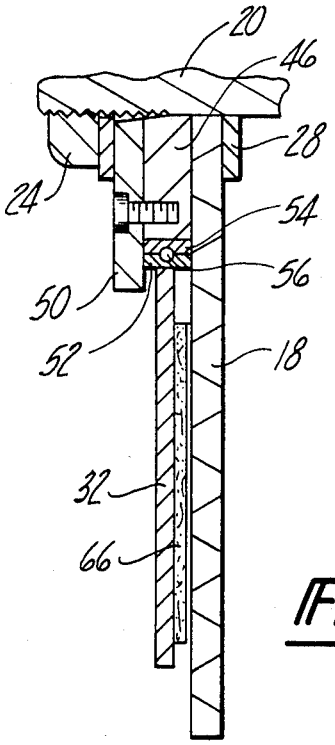
FIG. 5 is a fragmentary, sectional view of a lower portion of the blade arbor mounting having still another alternate form of the blade guard installed thereon.

Reference is now made to FIG. 5 where still another alternate construction is shown for biasing the arm 38 to rotate into covering relationship to the blade 18. In this embodiment, a relatively thin magnet 66 having a substantial surface area is applied to the inner face of the yoke 30, as by bonding or the like, in closely spaced relationship to one face of the blade 18 such that the blade 18 is well within the magnetic field of the magnet 66. Because of the attractive forces between the magnet 66 and blade 18, rotation of the blade 18 likewise causes magnet 66 (and therefore yoke 30) to rotate in the same direction as the blade 18, thereby applying the necessary rotational bias to the arm 38.

From the foregoing, it is apparent that the blade guard described above not only provides for the reliable accomplishment of the objects of the invention, but does so in a particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

I claim:

1. For use with a saw of the type including a circular cutting blade mounted for rotation with a motor driven arbor and a flat workpiece support surface having an opening therein through which a portion of the blade extends, a guard for the blade comprising:

a blade guard arm having a thickness no greater than the thickness of the blade whereby said arm may pass through a cut in a workpiece made by the blade, said arm extending through the support surface opening rearwardly of the blade and extending therefrom in curvilinear fashion over the blade to dispose the free leading end of said arm adjacent the support surface at the front of the blade so as to protectively cover the entire cutting edge of the blade portion;

means for mounting said arm on the saw for yieldable pivotal movement relative to said support surface about the rotational axis of the blade in response to engagement of said leading end thereof with a workpiece so as to expose a section of the blade portion to the leading edge of the approaching workpiece and allow cutting of the workpiece by the blade; and means biasing said arm for pivotal movement about said blade axis in the direction of blade rotation so as to maintain said leading end of said arm adjacent the support surface at the front of the blade and maintain said arm in protectively covering relation to the entire cutting edge of the blade portion subject to selective and limited yieldable displacement by the leading edge of the approaching workpiece;

said mounting means including a first member mounted on said arbor for rotation with said arbor and a second member rotatably mounted on said first member whereby to rotate independently of the rotation of said arbor, said second member including a portion extending radially outward from said first member, said arm being secured to the outer extremity of said radially extending portion.

2. The guard of claim 1, wherein said biasing means includes means for generating sliding friction between said first and second members.

3. The guard of claim 1, wherein said biasing means includes a magnet connected with said second member and closely spaced from said blade, said magnet generating a magnetic field resulting in attractive forces between said magnet and said blade.

4. The guard of claim 1, including a bearing between said first and second members.

5. Apparatus for guarding the blade of a table saw, said table saw including a motor driven, rotatable arbor, a tooth circular saw blade mounted on said arbor for rotation with said arbor and a table having a support surface upon which a workpiece may be supported during sawing thereof, said support surface including a slot therein through which a portion of said blade extends above said support surface, comprising:

a first member mounted on said arbor for rotation with said arbor;

a second member rotatably mounted on said first member, said second member including a radial extension and an arcuately shaped flat guard arm, having a thickness no greater than the thickness of the blade and disposed coplanar with the blade, connected to said radial extension and extending upwardly therefrom through said slot above said support surface rearwardly of the blade and extending forwardly therefrom in curvilinear fashion over and in closely spaced relation to the teeth of the blade to dispose the free leading end of said arm adjacent the support surface at the front of the blade; and means biasing said second member for rotation on said first member in the direction of rotation of the blade so as to bias said arm for pivotal movement about the arbor axis to maintain the leading end of said arm adjacent the support surface at the front of the blade and maintain said arm in protectively covering relation to the entire cutting edge of the blade portion subject to selective and limited yieldable displacement by the leading edge of the approaching workpiece.

6. The blade guard apparatus of claim 5, wherein said biasing means includes means for generating sliding friction between said first and second members.

7. The blade guard apparatus of claim 5, wherein said biasing means includes means for creating magnetic attraction between said second member and said blade.

8. The blade guard apparatus of claim 5, including a roller bearing between said first and second members.

9. The blade guard apparatus of claim 5 including a roller on the free end of said arm yieldably engaging a workpiece.

10. In a table saw of the type including a table on which a workpiece to be sawed is supported and including a slot therein through which the cutting edge of a saw blade may extend above said table, a motor driven rotatable arbor below said table, and a circular saw blade mounted for rotation on said arbor; a guard for covering said cutting edge of said blade comprising:

a guard arm lying in the plane of said saw blade, having a thickness no greater than the thickness of said saw blade, having an arcuate inner edge closely spaced from the circular cutting edge of said saw blade so as to protectively cover said cutting edge above said table, and extending downwardly through said slot at the rear of the blade beneath said table;

a yoke including a first portion mounted on said arbor for rotation independent of the rotation of said arbor and a second portion connecting the rear end of said guard arm with said first portion; and means coupled with said yoke for normally biasing said yoke for rotation about said arbor in the direction of blade rotation so as to bias said arm for pivotal movement about said arbor to maintain the free leading end of said arm adjacent the support surface at the front of the blade and maintain said arm in protectively covering relation to the entire cutting edge of the blade portion subject to selective and limited yieldable displacement by the leading edge of the approaching workpiece.

11. The guard of claim 10, wherein said yoke includes a substantially flat plate and said second portion includes a member which extends radially from said arbor.

12. The guard of claim 10, including a roller on the free end of said guard arm for yieldably engaging a workpiece.

13. In combination:

(A) an arbor adapted to be a power source;

(B) a circular saw blade fixedly secured to said arbor for rotation therewith upon actuation of the power source; and (C) a blade guard assembly including;

(1) a mounting portion journalled for rotation on said arbor, adjacent said saw blade, (2) a flat guard arm portion rigidly joined to said mounting portion, lying in the plane of said saw blade, having a thickness no greater than the thickness of said saw blade, and having an arcuate inner edge closely spaced from the circular cutting edge of said saw blade and concentric with the axis of said arbor, and (3) counterweight means secured to said mounting portion in a position radially offset from said arbor axis.

14. For use with a saw of the type including a circular cutting blade mounted for rotation on a motor driven arbor and a flat workpiece support surface having an opening therein through which a portion of the blade extends, a guard for the blade comprising:

a blade guard arm having a thickness no greater than the thickness of said blade whereby said arm may pass through a cut in a workpiece made by said blade, said arm extending through said opening and protectively covering the entire cutting edge of said blade portion;

means for mounting said arm on said saw for yieldable pivotal movement relative to said support surface in response to engagement with a workpiece whereby to expose a section of said blade portion to the workpiece and allow cutting of the workpiece by said blade;

said mounting means including a first member mounted on said arbor for rotation with said arbor and a second member rotatably mounted on said first member to rotate independently of the rotation of said arbor, said second member including a portion extending radially outward from said first member, said arm being secured to the outer extremity of said radially extending portion;

said guard further including means for normally biasing said arm to rotate in the direction of rotation of said blade to maintain said arm in protectively covering relationship over said blade; and said biasing means including a counter weight secured to said second member.

15. Apparatus for guarding the blade of a table saw, said table saw including a motor driven, rotatable arbor, a toothed circular saw blade mounted on said arbor for rotation with said arbor and a table having a support surface upon which a workpiece may be supported during sawing thereof, said support surface including a slot therein through which a portion of said blade extends above said support surface, comprising:

a first member mounted on said arbor for rotation with said arbor;

a second member rotatably mounted on said first member, said second member including a radial extension and an arcuately shaped guard arm connected to said radial extension and extending through said slot above said support surface, said guard arm covering and being closely spaced from the teeth of said blade along said blade portion;

said blade guard further including means for normally biasing said second member to rotate relative to said arbor in a direction which maintains said arm in covering relationship over said blade portion; and said biasing means including a counterweight connected to said second member.

16. Apparatus for guarding the blade of a table saw, said table saw including a motor driven, rotatable arbor, a toothed circular saw blade mounted on said arbor for rotation with said arbor and a table having a support surface upon which a workpiece may be supported during sawing thereof, said support surface including a slot therein through which a portion of said blade extends above said support surface, comprising:

a first member mounted on said arbor for rotation with said arbor;

a second member rotatably mounted on said first member, said second member including a radial extension and an arcuately shaped guard arm connected to said radial extension and extending through said slot above said support surface, said guard arm covering and being closely spaced from the teeth of said blade along said blade portion;

said blade guard further including an insert removably mounted on said table and having an upper surface substantially coplanar with said support surface, said slot being defined in said upper surface of said insert, said slot including a recess in one side thereof defining an opening in said insert which is wider than said slot; and said arm including means on one end thereof for engaging said workpiece and having a thickness greater than the thickness of said blade, said engaging means being insertable through said recess during installation and removal of said first and second members on said arbor.

* * * * *

UNITED STATES PATENT AND TRADEMARK OFFICE

CERTIFICATE OF CORRECTION

PATENT NO. : 4,576,073

DATED : March 18, 1986

INVENTOR(S) : Robert J. Stinson

It is certified that error appears in the above-identified patent and that said Letters Patent is hereby corrected as shown below:

Column 13, line 2 "an arbor adapted to be a power source" should be --an arbor adapted to be connected to a power source--.

Signed and Sealed this

*Twenty-second* Day of *July 1986*

[SEAL]

*Attest:*

DONALD J. QUIGG

*Attesting Officer*

*Commissioner of Patents and Trademarks*